US006279492B1

(12) United States Patent
Larson et al.

(10) Patent No.: US 6,279,492 B1
(45) Date of Patent: Aug. 28, 2001

(54) METHOD OF THERMALLY DECOMPOSING WASTE MATERIALS

(75) Inventors: Jack B. Larson, Cle Elum, WA (US); James C. Branscome, Collinsville, VA (US)

(73) Assignee: Atlantic Pacific Energy Systems, Inc., Martinsville, VA (US)

( * ) Notice: Subject to any disclaimer, the term of this patent is extended or adjusted under 35 U.S.C. 154(b) by 0 days.

(21) Appl. No.: 09/364,576

(22) Filed: Jul. 30, 1999

Related U.S. Application Data

(62) Division of application No. 08/966,135, filed on Nov. 7, 1997, now Pat. No. 5,967,062.
(60) Provisional application No. 60/031,320, filed on Nov. 19, 1996.

(51) Int. Cl.[7] ..... F23G 5/20; F23G 5/44
(52) U.S. Cl. ..... 110/346; 110/101 R; 110/246; 110/255; 432/105; 432/113; 432/117; 432/118
(58) Field of Search ..... 110/101 R, 108, 110/203, 210, 211, 212, 226, 227, 228, 235, 246, 255, 257, 258, 267, 229, 345, 346; 432/95, 106, 103, 105, 108, 110, 111, 112, 113, 116, 117, 118

(56) References Cited

U.S. PATENT DOCUMENTS 1,904,781 * 4/1933 Crawford ..... 432/105 X
2,020,960 * 11/1935 Pehrson et al. ..... 432/105 X
2,878,004 * 3/1959 Saeman ..... 432/108 X
3,357,382 * 12/1967 Matteini ..... 432/108 X
3,682,453 * 8/1972 Powell ..... 432/116
3,705,711 * 12/1972 Seelandt et al. ..... 110/246 X
3,882,801 * 5/1975 Bolle ..... 110/246 X
3,946,680 * 3/1976 Laman .
4,060,042 * 11/1977 Baraldi et al. ..... 432/110 X
4,180,004 * 12/1979 Johnson ..... 110/346
4,551,051 * 11/1985 Hofbauer et al. .
4,565,138 * 1/1986 Ueda et al. ..... 110/346
4,895,083 * 1/1990 McDilda ..... 110/235
4,922,841 * 5/1990 Kent ..... 110/212 X
5,173,045 * 12/1992 Macri ..... 432/116 X
5,174,750 * 12/1992 Flading et al. ..... 432/117 X

* cited by examiner

*Primary Examiner*—Ira S. Lazarus
*Assistant Examiner*—Ljiljana V. Ciric
(74) *Attorney, Agent, or Firm*—C. Fred Rosenbaum; Bryan D. Wright

(57) ABSTRACT

A method of burning tires in a horizontally rotating combuster includes the steps of loading the tires into a rotating combustion chamber through a traveling air lock and burning them until they are reduced to ash; enhancing combustion by tumbling the burning tires in a tapered rotating chamber while adding preheated draft air; controlling the intake draft air using thermal expansion of the rotary combustion chamber to activate the draft control valve; advancing the residual ash with each successive revolution of the combustion chamber by use of angled flights on the inner surface of the chamber to an afterburner for completion of the combustion and disposal of the ash.

11 Claims, 3 Drawing Sheets

METHOD OF THERMALLY DECOMPOSING WASTE MATERIALS

This application is a division of application Ser. No. 08/966,135, filed Nov. 7, 1997, now U.S. Pat. No. 5,967, 062. Priority is claimed for this application under 35 USC 119(e) based on provisional application Ser. No. 60/031,320, filed Nov. 19, 1996.

BACKGROUND OF THE INVENTION

1. Field of the Invention

The present apparatus relates to the disposal of tires through combustion. It has been shown that tire combustion is possible by using stationary incinerators. In such devices, tires are not mixed as they burn and the solid by-products of combustion are gathered in collection ducts. In contrast, the present apparatus differs from previous methods of tire combustion in that the entire combuster rotates. Tires are tumbled and retained in the primary burn zone for as long as possible. After tires have been reduced to ash, solid waste is forwarded to the exhaust area using a series of baffles, I.e. flights. Once the hot gases and solid debris have left the exhaust area, they enter the afterburner, where complete burning of the remaining volitiles is performed using a secondary enrichment of oxygen.

2. Prior Art

The U.S. Pat. No. 3,946,680; U.S. Pat. No. 4,565,138; U.S. Pat. No. 4,551,051; U.S. Pat. No. 4,895,083; and U.S. Pat. No. 4,180,004 disclose various apparatuses used for combustion of tires. This apparatus; however, differs from previous efforts at tire combustion in several ways.

U.S. Pat. No. 4,551,051 and U.S. Pat. No. 4,565,138, illustrate an inclined ramp and a ram, respectively, for loading tires into the primary burn zone, U.S. Pat. No. 4,180,004 teaches the step of shredding the tires before delivery to the combuster.

U.S. Pat. No. 4,895,083; U.S. Pat. No. 4,565,138; and U.S. Pat. No. 3,946,680, burn the tires as a resting pile.

SUMMARY OF THE INVENTION

It is the object of the invention to provide a means for disposing of tires by combustion using a rotating burn chamber.

A principle objective of this invention is to provide a means for removing the solid by-products of the tire combustion from the primary burn area by using a series of inclined baffles, resembling the threads of an internal lead screw, which carry the debris toward the exit of the combuster at a rate slow enough to allow thorough combustion.

Another important objective of this invention is to provide a method for loading the tires into the combuster using an airlock with an automated lid.

Another important objective of this invention is to provide a method for loading tires into the combuster using a sealed airlock which reduces the ingress of air and the egress of the volatile gases through the loading opening and places the tires into the combuster in a controlled manner.

Another important objective of this invention is to provide a method for burning tires based on a rotating combuster that tumbles the tires as they burn to ensure thorough and rapid combustion.

Another important objective of this invention is to provide a means of enhancing tire combustion using a preheated draft.

Another important objective of this invention is to provide a means for controlling the intake draft using the thermal expansion of the rotary combustion chamber to activate a draft control valve.

Another important objective of this invention is to provide shielded draft entry to prevent debris from back flowing into the draft air ducts.

Another important objective of this invention is to provide a means for preventing tire refuse from leaving the burn area prematurely by using a ramp in the rotary combustion chamber.

Other important objectives of this invention include preheating the draft air to promote rapid combustion in the primary burn zone and the use of a tire fueled afterburner to eliminate remaining volatiles escaping from the primary burn zone.

DESCRIPTION OF THE PREFERRED EMBODIMENT

Overview

The combustion process utilizes two main chambers; the rotary combustion chamber and the secondary combustion chamber. First, tires are loaded into the rotary combustion chamber by means of an automated airlock. Once inside, the tires or fuel is exposed to a preheated draft that provides oxygen-rich air to the primary burn zone. After the tires have been reduced to ash and hot gases, the by-products are forwarded into the secondary combustion chamber or afterburner. Within the afterburner, solid waste is removed from the airstream and remaining volatiles are eliminated using a secondary enrichment of oxygen.

Figure 1:
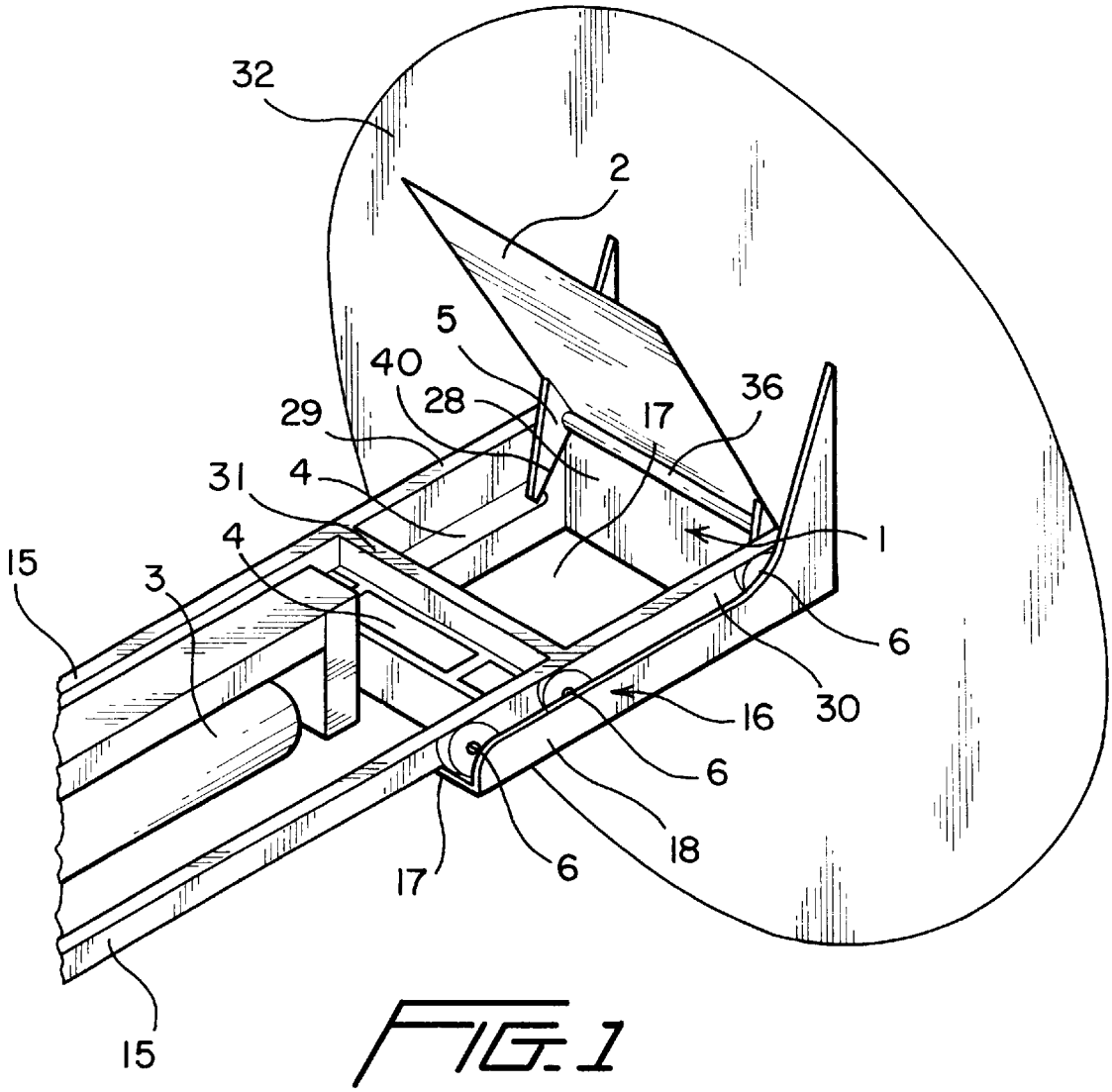
FIG. 1 is an isometric drawing of the tire injector airlock.

The tires 41 are loaded into the rotary combustion chamber by means of a tire injecting airlock, shown in FIG. 1. A sliding carriage 1 is used to transport tires into the rotary combustion chamber one at a time. As shown in FIG. 1, the sliding carriage 1 is formed as a bottomless_rectangular box with a forward wall 28, side walls 29 and 30 and a rear wall 31. As shown in FIG. 1, the forward wall 28 forms the portion of the airlock between the interior of the combustion chamber and the outside environment. FIG. 1 shows an automated lid 2 on the carriage which has been designed to open and close automatically at the appropriate time during the tire loading process. The lid 2 is connected to the sliding carriage 1 by a hinge 36_extending between the side walls 29 and 30. In order to open the lid, for example, a pneumatic cylinder 3 is employed. The cylinder applies force on a lever arm 5, mounted below the lid, by means of a mechanical assembly 4 which extends through the rear wall 31. This arrangement allows the cylinder to hold the lid open because the force acting on the lever arm 5 has enough leverage and magnitude to hold the lid in position.

The sliding carriage 1 is movably mounted in a channel shaped ramp 16. The ramp 16 is mounted on the wall 32 which closes the front end of the combustion chamber. The ramp 16 surrounds the loading aperture 33, shown in FIG. 3. The ramp 16 has a planar surface 17 of which a portion, shown encompassed by the walls of the sliding carriage in FIG. 1, forms the bottom of the airlock. Wheels 6 are mounted on the upstanding sidewalls 18 of the ramp 16.

Once the tire has been loaded, the lid 2 is closed by reversing the force from the pneumatic cylinder 3. This action applies less force at the lever arm 5 and causes the lid to rotate about its hinge 36 to a closed position. Consequently, the movements of the mechanical assembly 4 operated by the pneumatic cylinder play a major role in automating the lid of the carriage.

Figure 2:
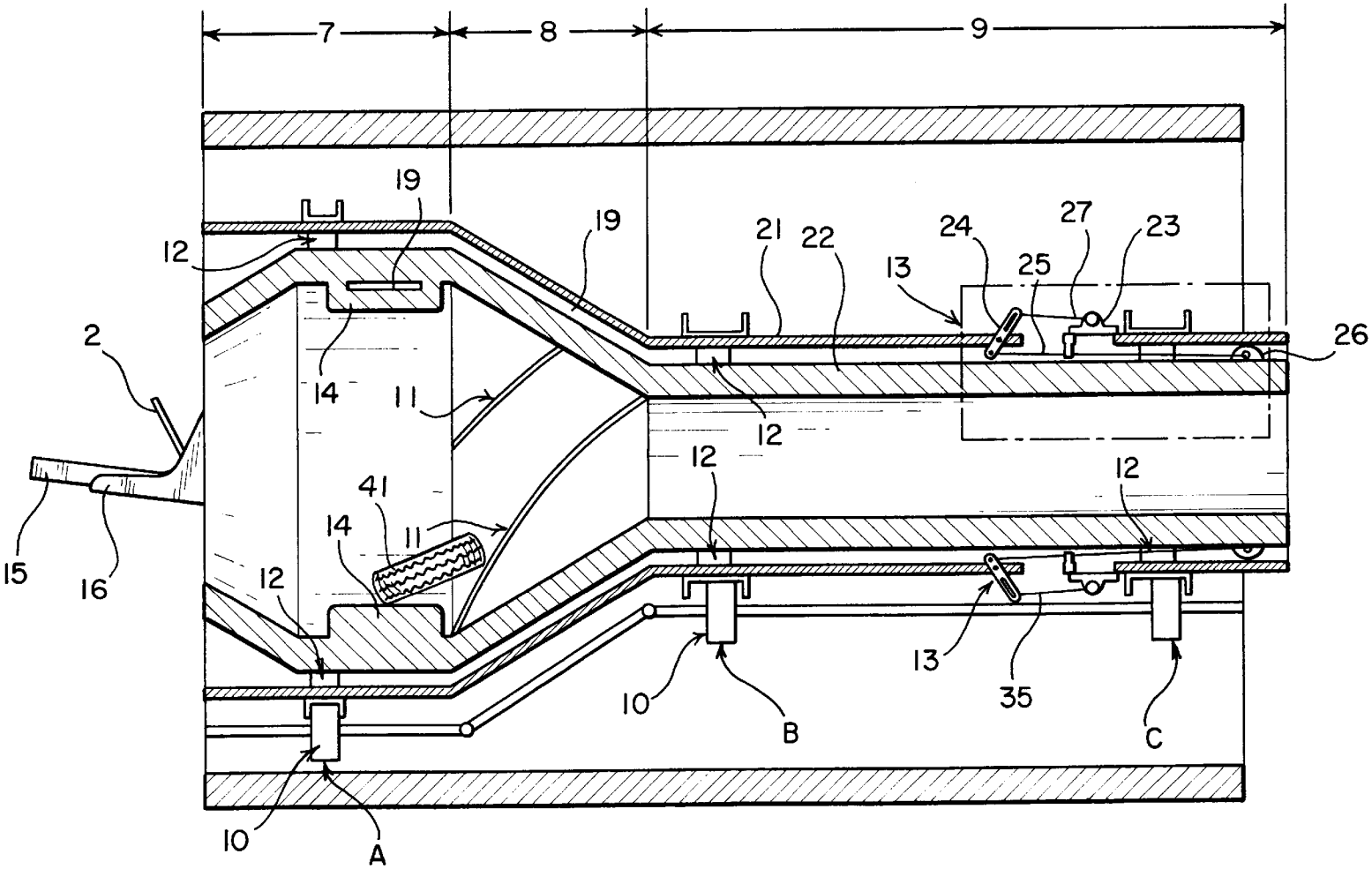
FIG. 2 is a cross sectional view of the rotary combustion chamber as viewed from the side.

In addition to controlling the carriage lid 2, the pneumatic cylinder 3 is also used to inject tires into the rotary combustion chamber. Once a tire has been loaded into the carriage, initial extension of the pneumatic cylinder's piston seals the tire in the carriage by automatically closing the lid 2 by movement of the mechanical assembly 4 toward the forward wall 28 of the carriage. Further extension of the piston and mechanical assembly 4 brings the sloped forward surface 40 of the lever arm into contact with the forward wall 28 of the carriage thereby rolling the sealed carriage 1 across a series of wheels 6 and into the rotary combustion chamber shown in FIG. 2. Once inside, the carriage frame 1 is supported by its track 15 over a bottomless region opening directly into the primary burn zone 7. Because the sealed carriage is bottomless, the carriage will empty before the rear wall 31 is extended into the rotary burn chamber thereby maintaining the separation between the interior of the burn chamber and the outside environment. The tire drops into the rotary combustion chamber and the piston of the pneumatic cylinder 3 is subsequently reversed withdrawing the empty carriage onto the ramp 16.

Reversing the piston of the pneumatic cylinder 3 causes the carriage frame 1 to retreat in a linear manner until the motion is stopped by a cushion cylinder (not shown). After the frame 1 has been returned to its original position, further retraction of the assembly 4 by the pneumatic cylinder 3 applies enough force on the lever arm 5 to cause the lid 2 to open, ready for the next tire to be added.

Collectively, regions or zones 7, 8, and 9 comprise the rotary combustion chamber. Essentially, it is a tube of varying diameters across its longitudinal axis which may be constructed of one or several sections. The purpose of the rotary combustion chamber is to provide a means for burning tires and removing the waste generated from combustion. This is accomplished by rotating the combuster on powered rollers 10 and tumbling the burning debris across a series of inclined baffles 11 positioned along the inner wall of the rotary combustion chamber.

As the rotary combustion chamber rotates, provisions are made to support it under longitudinal and radial thermal expansion. The rotary combustion chamber is supported at positions A, B, and C by powered rollers 10. Radial thermal expansion is addressed by using bearings 12 that are sized to fit the rotary combustion chamber at the running temperature. Longitudinal thermal expansion is limited at position A such that the rotary combustion chamber can expand only towards its narrow end. The uniaxial thermal expansion is used in conjunction with mechanical duct valves 13 to control the draft balance in the rotating chamber.

The primary burn zone 7 accelerates tire combustion by tumbling the tires within the burn chamber and exposing them to oxygen-rich, preheated draft air. Heat is recovered from the combustion process by draft air passing through the draft passage 19 between the outer layer 21_and the inner layer 22 of the rotary combustion chamber wall and returned to the primary burn zone 7 at shielded draft entrances 14. The shields covering the draft entrances are aligned so as not to allow debris to backflow into the air ducts and they protrude into the burn zone far enough to help tumble the tires as the rotary combustion chamber rotates. Tumbling the tires and using preheated draft air ensures that all burnable materials undergo accelerated combustion in the primary burn zone.

The reduced tire conveyer zone 8 continuously removes solid waste from the primary burn zone 7 and prevents unburned tires from advancing prematurely in the combuster. The slope of the tube in this region of the combuster serves as a means for fuel retention; unburned tires fall backwards into the primary burn zone 7 until they are reduced to small pieces, and ash. These small pieces are then carried by flights or baffles 11, resembling the threads of an internal lead screw, toward the exhaust zone 9 at a rate slow enough to allow completion of the tire-reduction process. The flights 11 continuously lift solid material from the bottom of the combuster, then drop it so that it falls through the hot gases. Turning the material with the flights enhances combustion by ensuring good temperature uniformity. Consequently, the slope of the reduced tire conveyor zone provides maximum fuel retention, and the flights 11 along the inner wall promote continuous waste removal and uniform tire combustion.

Figure 3:
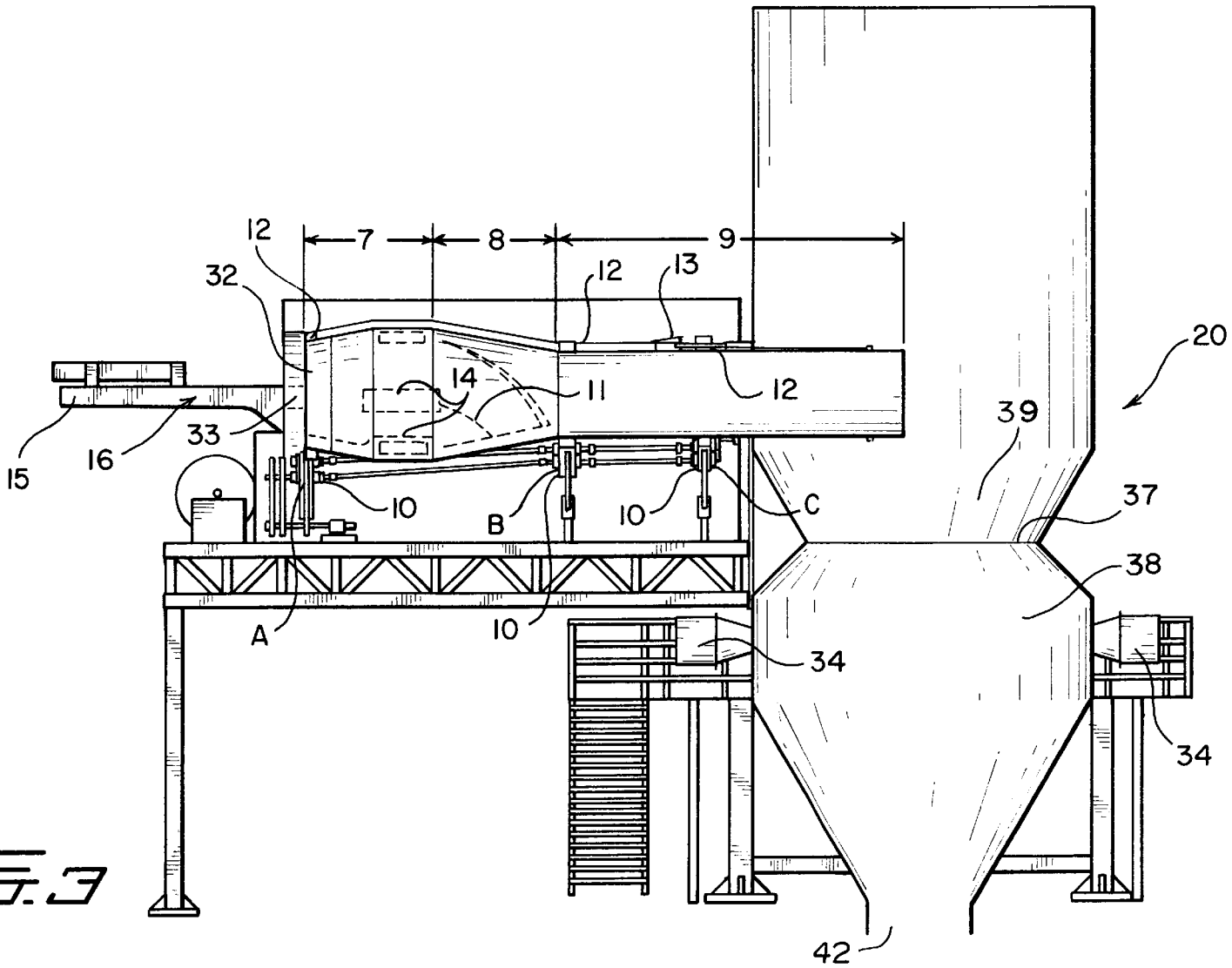
FIG. 3 is a cross sectional view of the rotary combustion chamber including the afterburner as viewed from the side.

The exhaust tube zone 9 routes the burned debris and hot gases to an afterburner 20, shown in FIG. 3, and provides a means for controlling the draft balance in the rotating chamber. The end of the tube protrudes slightly into the afterburner so that ash drops to the bottom, while hot gases continue upwards through the afterburner, to a boiler or some other device downstream.

Draft balance control is accomplished using the thermal expansion of the unit to activate a draft control valve 13. The draft control valve 13 has a flap valve 23 mounted on outer layer 21 of the rotary combustion chamber. The position of the flap valve 23 is controlled by an elongated actuator 24 and biasing device 35. The actuator is pivotally mounted on outer layer 21. One end of the actuator 24 is connected to the flap valve 23 and the other end is connected at 26 to the inner layer 22 by wires or rods 25. When the system is running cool, thermal cooling will cause the duct switch 13 to direct draft air straight to the primary burn zone 7, as_shown in FIG. 2. Entering draft air will in turn increase combustion in the primary burn zone and return the system to higher temperatures. In contrast, when the system is running hot, longitudinal thermal expansion causes inner layer 22 to elongate moving 26 longitudinally to pivot actuator 24 opening flap valve 23 to direct oxygen-rich draft air away from the primary burn zone 7 and into the afterburner. The oxygen-rich draft air enters the afterburner through opening 42 and mixes with the hot gases within the afterburner, causing complete combustion of any remaining volatiles, while the ash drops to the bottom of the afterburner for removal and processing.

The purpose of the afterburner is to eliminate remaining volatiles from the reduced tires and to remove ash from the flow of hot gases. In order to enhance the secondary combustion process, the reduced tires are exposed to a secondary enrichment of oxygen in the secondary combustion chamber 39. Any remaining ash is thrown against the inner wall of the afterburner, whereupon the ash slides along the wall toward the bottom of the afterburner for collection and removal.

In order to bring the afterburner to operating temperature in a timely manner, the afterburner has been equipped with a semi-isolated preheat chamber 38 separated from the secondary combustion chamber 39 by a partition 37 though which heat is transferred. Oil burners 34 within the chamber have the ability to supplement energy requirements in the absence of tire fuel. Most of the time, however; the preheat burners will not be running, as the heat energy from the tire fuel will be enough to eliminate remaining volatiles once the secondary enrichment of oxygen is applied. Once the tires have completed the combustion process, the ash is removed from the afterburner from the base of the structure after having passed through partition 37 and the hot gases are forwarded to a boiler or some other device downstream.

The rotary tire combuster provides a means to improve the combustion of passenger and highway truck tires. The intake draft is preheated, the tires are tumbled, and the apparatus is supported in ways which work cohesively to enhance the combustion process.

The supports, for example, allow longitudinal thermal expansion of the apparatus as the unit changes temperature. As a result, changes in the length of the combuster reposition a draft control valve attached to the rotary combustion chamber. This valve, in turn, directs air toward the primary burn zone, forming a preheated draft, or towards the afterburner, providing a secondary enrichment of oxygen. In either case, oxygen rich air is automatically directed to different regions of the apparatus in order to control the temperature and to use the draft air as efficiently as possible.

Tires are loaded using an automated airlock that is designed to minimize smoke and energy losses at the entrance. Once inside the rotary combustion chamber, the tires are retained in the primary burn zone until reduced to ash and hot gases. Continual rotation of the combuster tumbles the debris across a series of internally mounted baffles that lift the ash from the bottom of the pile and advance it towards the exhaust end of the tube. Once past the exhaust, any remaining volatiles are eliminated in an afterburner using secondary enrichment of oxygen. In addition to separating the ash from the fuel, the baffles, or flights, turn the debris in order to ensure good temperature uniformity.

Consequently, the rotating combuster is an improvement in the field of tire combustion. It tumbles the burning mixture and channels draft air in ways which enhance the combustion process. Although a conveyor belt is not used in the primary burn zone, as in other conbusters, its streamlined design and other qualities make it a viable apparatus for the production of tire derived fuel.

In a general manner, while there has been disclosed an effective embodiment of the invention, it should be well understood that the invention is not limited to such an embodiment as there might be changes made in the arrangement, disposition and form of the parts without departing from the principle of the invention embodied in the claims.

We claim:

1. A method of thermally decomposing waste materials comprising the steps of a) providing a frame having powered rollers supporting a horizontally elongated furnace having a large diameter primary burn chamber portion and a smaller diameter exhaust portion, said primary burn chamber and said exhaust portion being integrally connected through a tapered conveyor portion, said conveyor portion having internal baffles shaped as a helix, said furnace having an inner wall and an outer wall with a draft passageway located between said walls, with one end of said draft passageway located in said primary burn chamber and the other end having a draft control valve covering an opening in said outer wall, b) adding waste materials to said primary burn chamber and thermally decomposing said waste materials, c) continuously mixing said waste materials in said primary burn chamber by rotating said powered rollers, said mixing resulting from said waste materials advancing partially along said helix then returning to said large diameter burn chamber through the action of gravity, d) moving any combustion residue of the waste materials from the primary burn chamber through said conveyor portion and into said exhaust portion by advancing said residue by the action of said baffles, e) providing a balanced draft to said primary burn chamber through automatic actuation of said draft control valve by closing said draft control valve by mechanical bias at a lower temperature, and by opening said draft control valve in response to the difference in thermal expansion between said inner wall and said outer wall at a higher temperature.

2. A method of thermally decomposing waste materials comprising the_steps of a) providing a frame supporting an elongated combustion chamber, said frame carrying powered rollers in contact with said elongated combustion chamber, said rollers producing rotary movement of said elongated combustion chamber and providing power to said rollers resulting in rotary movement of said elongated combustion chamber, b) providing a large diameter primary burn chamber zone and a smaller diameter exhaust tube zone in said elongated combustion chamber, said large diameter primary burn zone and said smaller diameter exhaust tube being integrally connected through a tapered conveyer zone, said combustion chamber having internal baffles adapted move said waste materials from said large diameter primary burn zone to said smaller diameter exhaust tube zone upon rotary movement of said combustion chamber, c) providing waste materials in said large diameter primary burn zone and thermally decomposing said waste materials, and d) providing said combustion chamber with inner and outer wall layers, said inner and outer wall layers being spaced apart forming a draft passageway for supplying air to said large diameter primary burn zone, one end of said draft passageway opening into said large diameter primary burn zone, said one end of said draft passageway having a shield structure preventing combustion products from entering into said passageway during rotation of said combustion chamber.

3. A method of thermally decomposing waste materials as claimed in claim 2 whereby said tapered conveyer zone provides a barrier for certain sized partially decomposed waste materials during rotation of said combustion chamber until said waste materials are sufficiently reduced in size.

4. A method of thermally decomposing waste materials as claimed in claim 3 whereby said tapered conveyer zone is provided with spaced apart inner and outer wall layers and said baffles are disposed on the inner wall layer of said conveyer zone in the form of a helix to advance said waste materials toward said exhaust tube zone, said tapered zone and said baffles cooperating to allow smaller pieces of waste material to exit while returning larger pieces to said large diameter primary burn zone during rotation of said combustion chamber.

5. A method of thermally decomposing waste materials as claimed in claim 2 whereby said frame comprises external braces cooperating with said powered rollers to support and rotate said combustion chamber under thermal expansion, said large diameter primary burn zone fixed in said frame to permit thermal expansion along the longitudinal axis in the direction of said smaller diameter exhaust tube zone.

6. A method of thermally decomposing waste materials as claimed in claim 2 whereby said draft passageway has at least one other opening remote from said large diameter primary burn zone, said other opening for balancing draft air, a draft control valve located on said other opening for controlling draft air balance, said draft control valve activated to open and close said other opening by variances in longitudinal thermal expansion between said inner wall layer and said outer wall layer of said combustion chamber, said valve opening in response to the greater longitudinal thermal expansion of said inner wall layer in relation to said outer wall layer.

7. A method of thermally decomposing waste materials as claimed in claim 2 whereby said combustion chamber is operatively connected to an afterburner, said smaller diameter exhaust tube zone of said combustion chamber extending into said afterburner, upon rotation of said combustion chamber said afterburner receiving the combustion products in the form of hot gases and ash, said afterburner providing a source of air to said large diameter primary burn zone through said draft passageway, said afterburner providing a secondary combustion chamber to eliminate volatiles from said combustion products, and said remaining combustion products being removed from said afterburner.

8. A method of thermally decomposing waste materials as claimed in claim 7 whereby said afterburner includes a semi-isolated preheat chamber, said preheat chamber providing hot air to bring the afterburner up to operating temperatures.

9. A method of thermally decomposing waste materials as claimed in claim 8 whereby said draft control valve balances draft air between said large diameter primary burn zone and said afterburner.

10. A method of thermally decomposing waste materials comprising the steps of a) providing a combustion chamber, said combustion chamber having an end wall, b) providing an opening in said end wall for continuously loading waste materials into said combustion chamber, c) providing an airlock about said opening in said combustion chamber during loading of said waste materials into said combustion chamber, said airlock comprising a channel-shaped ramp connected at one end about said opening, said channel-shaped ramp having integral vertical sidewalls and a planar bottom, said vertical sidewalls carrying rotating wheels, a movable carriage mounted in said channel-shaped ramp, said movable carriage having a forward end wall of a size to substantially close said opening when said carriage is at rest, said movable carriage having side walls integrally connected to said forward end wall, said side walls carrying rails extending beyond said carriage in the direction opposite said forward end wall, said movable carriage having a rear end wall, said rear end wall sized to substantially close said opening when said carriage is in said combustion chamber, and a hinged lid connected to said side walls, d) opening said lid and depositing waste materials into said movable carriage, e) closing said lid on said carriage and moving said carriage toward said opening in said combustion chamber, f) moving said closed carriage through said opening in said combustion chamber by cooperating movement of said rails and said wheels whereby said opening in said combustion chamber remains substantially closed during the movement of said carriage, g) removing said waste materials from said carriage in response to gravity and thermally decomposing said waste materials, h) reversing the movement of said carriage and returning said carriage to said ramp, and I) opening said lid.

11. A method of thermally decomposing waste materials as claimed in claim 10 wherein said carriage is connected to a power-providing means for automatic movement of said carriage and operation of said lid, said power-providing means connected to said lid and said forward wall of said carriage through a piston, said lid connected to said power-providing means through a lever arm, whereby when said carriage is at a rest, upon initiation of said power-providing means, the following steps occur;

a) said piston moves in the direction of said opening to close said lid, b) continued movement of said piston operates said lever arm to engage said forward wall of said carriage, c) said carriage moves into said combustion chamber, d) said piston reverses its direction of movement, e) said carriage returns to the rest position, f) upon continued reverse movement of said piston, said lid opens through action of said lever arm, and g) said steps a) through f) are repeated.

* * * * *